US005966211A

United States Patent [19]

Lilja

[11] Patent Number: 5,966,211

[45] Date of Patent: Oct. 12, 1999

[54] OPTOELECTRIC SENSOR AND WEFT YARN MEASUREMENT AND FEEDING EQUIPMENT

[75] Inventor: Henrik Lilja, Angered, Sweden

[73] Assignees: IRO AB, Ulricehamn, Sweden; Picanol N.V., Ieper, Belgium

[21] Appl. No.: 08/983,311

[22] PCT Filed: Jul. 5, 1996

[86] PCT No.: PCT/EP96/02975

§ 371 Date: Apr. 13, 1998

§ 102(e) Date: Apr. 13, 1998

[87] PCT Pub. No.: WO97/03012

PCT Pub. Date: Jan. 30, 1997

[30] Foreign Application Priority Data

Jul. 11, 1995 [DE] Germany ..... 19525260

[51] Int. Cl.[6] ..... D01H 13/16

[52] U.S. Cl. ..... 356/238.2; 57/265; 57/81; 356/429

[58] Field of Search ..... 356/238.1, 238.2, 356/429; 250/559.32; 57/265

[56] References Cited

U.S. PATENT DOCUMENTS

| | | | |
|---|---|---|---|
| 3,772,524 | 11/1973 | Erbstein | 57/81 |
| 4,112,665 | 9/1978 | Werst | 57/81 |

FOREIGN PATENT DOCUMENTS

| | | |
|---|---|---|
| 0 519 281 | 12/1992 | European Pat. Off. . |
| 1 271 483 | 8/1961 | France . |
| 1 345 166 | 10/1963 | France . |
| 28 36 424 | 7/1979 | Germany . |
| 6 515 088 | 11/1966 | Netherlands . |
| 1 283 528 | 7/1972 | United Kingdom . |
| WO 89/00215 | 1/1989 | WIPO . |
| WO 90/06504 | 6/1990 | WIPO . |
| WO 92/09516 | 6/1992 | WIPO . |

*Primary Examiner*—Richard A. Rosenberger
*Attorney, Agent, or Firm*—Flynn, Thiel, Boutell & Tanis, P.C.

[57] ABSTRACT

An optoelectronic sensor device (S) for detecting a yarn passing through a scanning zone (3) comprises at least one light source (L, L'), at least one photoelectric receiver (R1, R2) which is responsive to light variations and which is connected to an evaluation circuit (C), and a slit aperture (A1, A1) arranged between the yarn and the receiver. In a weft-yarn measuring and storing device (F), the sensor device (S) forms a withdrawal sensor for the yarn which is withdrawn overhead from the storage body (B). According to the invention at least two receivers that are closely adjacent to each other are oriented towards the scanning zone, with the receiving surfaces (4, 5) of the receivers being each covered by an upstream slit aperture (A1, A2), except for a limited area. The slit apertures (A1, A2) are arranged relative to one another at an acute angle of not more than 90°.

19 Claims, 2 Drawing Sheets

OPTOELECTRIC SENSOR AND WEFT YARN MEASUREMENT AND FEEDING EQUIPMENT

FIELD OF THE INVENTION

The present invention relates to an optoelectronic sensor device having a light source and detector for detecting a yarn passing through a scanning zone, and to a weft-yarn measuring and storing device wherein the optoelectronic sensor device detects yarn being withdrawn from weft yarn measuring and storing device.

BACKGROUND OF THE INVENTION

In an optoelectronic sensor device which is known from GB-C-1 283 528, the transverse passage of a spun yarn is detected in a ring spinning machine, with the unwinding running yarn orbiting in an opening. The opening has a light beam passing diametrically therethrough, the light beam being emitted from a light source, which is arranged in an opening wall, and through the opening onto an opposite receiver. A slit aperture is arranged in front of the receiver. The receiver responds to light variations or to the shadow of the yarn which passes over the slit aperture. Disturbing factors, such as vibrations, extraneous light, or the like, can prompt the receiver to output a wrong signal, despite the fact that the yarn has not properly passed through the slit aperture in the scanning zone.

In weft-yarn measuring and storing devices, as typically used on weft looms for providing weft yarn, exact information as to when and that the weft yarn passes through a scanning zone upon withdrawal is required for controlling and monitoring the feed operation of each weft yarn. To this end, at least one withdrawal sensor is provided which is equipped with a receiver that is oriented towards the illuminated scanning zone and is responsive to light variations. Since vibrations, the effect of extraneous light, or other unwanted factors that are observed during practical operation also prompt the receiver to respond, the significance of the signals gained from the weft-yarn passages is not to be relied on. Therefore, a method has been adopted in practice in which two receivers which are closely arranged one after the other in the axial direction of the storage body are oriented towards the same scanning zone and in which a significant signal for the yarn passage is derived from the response of the two receivers in a differential circuit, the signal being distinguishable from signals produced by unwanted factors because of the fact that an unwanted factor is observed on both receivers at the same time and in the same manner, whereas the yarn is recorded by the two receivers such that the record is offset in time. Nevertheless, this known scanning sensor with the two receivers does not reliably operate for several reasons. The receiving surface of each receiver is approximately circular as a rule. The yarn which moves relative to the receiving surface is only gradually imaged by its reflective light or its shadow because of the circular form of the receiving surface and due to transitional imaging. In addition, the response sensitivity of the receiver in the edge portions of the receiving surface is weaker than near the center. The signal which is evaluated in the differential circuit is therefore weak because of the gradual signal increase and the also gradual signal decrease and requires considerable amplification efforts which, however, are undesirable in the case of unwanted factors. Furthermore, such measuring and storing devices imperatively operate with a distinctly axial reciprocating movement of the yarn supply border at the withdrawal side of the yarn supply on the storage body, especially with when yarn separation and/or when a lively pattern is being weaved. This results in a yarn withdrawal geometry in which yarn withdrawn from the last winding of the yarn supply varies its longitudinal orientation in the scanning zone between approximately axial and approximately circumferential, respectively related to the axis of the storage body. With an approximately axial orientation of the yarn in the scanning zone the yarn is perceived by both receivers at the same time and in a similar manner, which renders a distinction difficult, or even excludes it, with respect to unwanted factors that are also perceived at the two receivers at the same time and in a similar manner.

It is the object of the present invention to provide a simple optoelectronic sensor device of the above-mentioned type and a weft-yarn measuring and storing device in which a strong and significant useful signal which can easily be distinguished from signals caused by unwanted factors can be produced on the basis of the yarn passing therethrough. In the measuring and storing device, the withdrawal sensor is intended to supply exact information as to when and that the yarn has passed through the scanning zone, despite varying yarn withdrawal speeds, different yarn qualities and variations of the orientation of the yarn in the scanning zone. The term "yarn" generally refers to yarn-like substrates, such as threads, twisted threads, filaments, spun threads, wires, narrow bands, foil-slips, or the like.

However, complicated electronic sensor devices whose receivers image or sharply image the object to be scanned and require position-sensitive detectors, optical imaging systems and high-quality circuits are explicitly excluded. Such sensor devices are too complicated and expensive for scanning a yarn passing therethrough either as such or in a measuring and storing device and are thus excluded from use for other reasons as well (for instance WO 89/00215, EP-A-0529 281).

The above object is achieved in an optoelectronic sensor device wherein first and second slit apertures are arranged relative to each other at an angle of 90° or less, and in a weft-yarn measuring and storing device having such an optoelectronic sensor device.

In the optoelectronic sensor device and in the weft-yarn measuring and storing device, an exact, significant and strong useful signal which can easily be distinguished from signals resulting from unwanted factors is obtained during scanning of each yarn passage as a special advantage, i.e., under efforts which are small under constructional and circuitry aspects and are not costly. The orientation of the yarn direction in the scanning zone is of no importance any more, since the yarn passes through the two slit apertures at different times or with different geometrical location, so that the differential evaluation of the response of the two receivers leads, at any rate, to a clear signal which clearly differs from a signal resulting from an unwanted factor, because the unwanted factor is recorded at the two receivers at the same time and with the same geometrical location. Furthermore, a strong modulation of the signal is obtained on the basis of the yarn passage in the scanning zone because, on the one hand, the less sensitive edge portions of the receiving surfaces are covered and do not become operative and because, on the other hand, the yarn becomes visible in its full size at an extremely rapid pace (almost no transition) in each slit aperture (by its reflective light or its shadow). Since the time which passes up to a full imaging of the yarn onto the receiving surface portion narrowed by the slit aperture is extremely short, as is also the time up to a complete disappearance of the full image, the signal which is produced by a differential evaluation technique contains strong frequency portions which can be derived with little amplification efforts and which are not present in a signal produced by an unwanted factor. On the whole, the use of two receivers, two slit apertures and the geometrical arrangement of the slit apertures independently of the orientation of the yarn in the scanning zone, the strength and frequency of unwanted factors, and also largely independently of contaminations, results in a strong and significant signal obtained on the basis of a yarn passage, which can be further processed by taking little circuitry efforts. Use is made of simple and inexpensive receivers which respond to light variations. The response characteristics of these receivers, which are smooth as such, are respectively enhanced in an unexpected manner by the slit aperture during proper yarn passage. The receivers can be arranged in close relationship with one another. This advantageous result is guaranteed even at maximum yarn speeds which are customary in modern yarn-processing systems. However, it is also possible to use more than two receivers each with one respective slit aperture.

The edge portions of the receiving surface which are critical with respect to the response characteristics of receivers reacting to light variations preferably define a diameter greater than the slot aperature; However, it is also possible to make the slit aperture as long as or even longer than the diameter of the receiving surface.

In the embodiment wherein the receivers are jointly connected to an evaluation circuit the useful signal is produced from the response of the two receivers in the evaluation circuit which is designed as a differential circuit.

In the embodiment wherein one slit aperature extends in a circumferential direction of the storage drum and another slot aperature extends in an axial direction; a compact construction of the withdrawal sensor can be achieved, with the withdrawal sensor being virtually independent of the speed variations of the yarn moving through the scanning zone, and being above all independent of the respective orientation of the yarn in the scanning zone.

The embodiment wherein an imaginary extension of one slit aperatur intersects another slit aperature is especially expedient. It is thereby ensured that the yarn is perceived by both receivers only on portions of the receiving surfaces which are limited by the slit apertures, and independently of the orientation of the yarn in the scanning zone at different times and/or with different geometries.

An especially expedient embodiment has the slit apertures arranged in a T; A situation is here expedient where the transverse bar T is slightly spaced apart from the upright leg, resulting in an asymmetry during scanning of the yarn through the geometrical configuration of the slit aperture, the asymmetry being important for a distinction between useful signal and unwanted signal and for a strong useful signal.

The shapes of the slit apertures can be rectangular, double-concave or double-convex, and ensure that a full light impingement or shadowing of the portions of the receiving surface begins and stops, respectively, at a very rapid pace to achieve a frequency portion which is as high as possible for the useful signal.

Slit apertures of the same size are advantageous.

The embodiment wherein the slit apertures are arranged such that a movement of a yarn over the slit aperatures which is geometrically identical or in time is prevented. is especially important. Such an adaptation of the positions of the slit apertures to possible orientations of the yarn in the scanning zone rules out a situation where the yarn is perceived by the two receivers with the same geometry or at the same time.

The embodiment block-shaped holder with channels permits a compact, operationally safe and also reliable design of the withdrawal sensor. The holder with its channels, the receivers, the light source and the slit apertures is a component which is simple and inexpensive and which can be prefabricated with high accuracy and can advantageously be accommodated and easily replaced even within a limited space.

In the embodiment the channels are arranged in specific inclinations. the components are combined within a very confined constructional space.

In the embodiment wherein a transparent cover pane is provided on the holder the cover pane protects the components arranged in the holder from soiling or dust.

The slit apertures may be spaced apart in an axial direction of the storage body at a dimensional distance of approximately the width of the slit apertures. This dimensional distance has turned out to be advantageous.

Finally, in the embodiment wherein the slit apertures are formed in a plate which may be adjusted in position the respective position of the slit apertures and the relative position between the slit apertures can be set or adjusted.

BRIEF DESCRIPTION OF THE DRAWINGS

Embodiments of the subject matter of the present invention will now be explained with reference to the drawings, in which.

DETAILED DESCRIPTION

Figure 1:
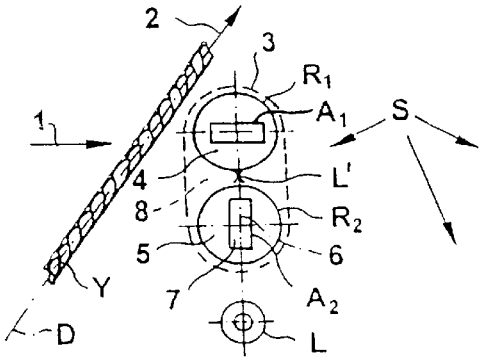
FIG. 1 is a diagrammatic top view on a sensor device.

FIG. 1 diagrammatically illustrates an optoelectronic sensor device S for detecting a yarn Y passing through a scanning zone 3, in a direction transverse to the longitudinal direction thereof (e.g. in the direction of arrow 1). In addition to the movement in the direction of arrow 1, yarn Y can simultaneously move in the direction of arrow 2, i.e., in its longitudinal direction D. The scanning zone S is a spatial area which is illuminated by at least one source of light L, and towards which two receivers R1, R2 are oriented with their receiving surfaces 4 and 5 in the illustrated embodiment. Instead of the light source L which is offset in the direction of receiver R1, R2, a central light source L' could either be provided at the side of the receivers or at the side opposite to the receivers. A slit aperture A1 and A2, respectively, is provided in front of the receiving surface 4 and 5, respectively, of each receiver R1, R2, namely in the optical path between yarn Y and the scanning zone 3, respectively, and each receiving surface 4 and 5, respectively. The two slit apertures A1 and A2 have, for instance, the same size, they have the same geometrical configuration and a respective cross-sectional main axis 6 and a secondary axis 7 which is perpendicular thereto. For instance, at a length of about 4 mm, the slit apertures A1, A2 have a width of about 1 mm. According to FIG. 7 the slit aperture A2 is oriented with its main axis 6 onto the main direction defined by the two receivers R1, R2, whereas the slit aperture A1 extends in a direction perpendicular thereto, with an extension of the slit aperture A2 intersecting the slit aperture A1 approximately in the center. The two slit apertures A1, A2 could also be rotated relative to one another, but the important point is that they enclose an acute angle or an angle of not more than 90° at the most with one another.

Figure 2A:
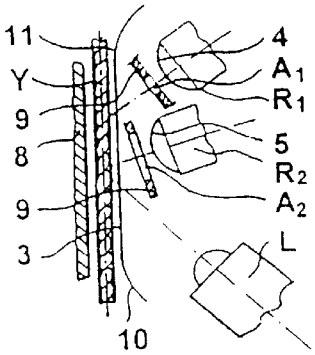
FIG. 2A is a side view, partly in section, of the sensor device shown in FIG. 1.
Figure 2B:
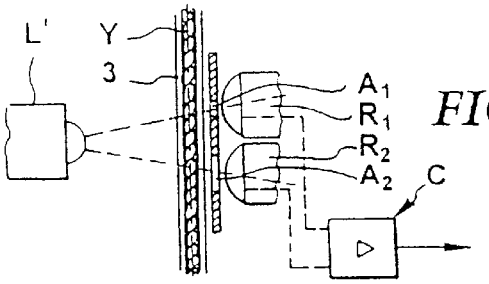
FIG. 2B is a side view, partly in section, of the sensor device shown in FIG. 1.

FIG. 2A and FIG. 2B are side views of two variants of the sensor device according to FIG. 1. In FIG. 2A, the light source L and the two receivers R1, R2 are located at the same side of the scanning zone 3 which has positioned thereunder an element 8 which is formed either as a reflector or as a light absorber. A passage gap for yarn Y is defined between element 8 and a cover 10 which is transparent, at least in part. The light source L and the two receivers R1, R2 are oriented relative to one another in consideration of specific light reflection angles. Both receivers R1, R2 are oriented towards the scanning zone 3, which is illuminated by the light source L, and reflective light impinges on said two receivers R1, R2. Each of the receivers R1, R2 has arranged upstream thereof a slit aperture A1, A2, e.g., in an aperture element 9.

When the sensor device S according to FIG. 2A operates according to the reflection principle, the light reflected by element 8 is shadowed according to the contour of yarn Y during the passage of yarn Y. Each receiver R1, R2 is responsive to the light variation. Both receivers R1, R2 are connected to an evaluation circuit C (FIG. 2B) which operates according to the differential principle and produces a useful signal from the difference between the photoelectric response signals of receivers R1, R2.

By contrast, when element 8 absorbs the light of light source L, receivers R1, R2 are responsive to the light reflected from yarn Y.

The sensor device S according to FIG. 2B operates according to the light barrier principle, i.e., the light from light source L' passes through the scanning zone 3 and impinges on the receivers R1, R2 which during passage of yarn Y are shadowed according to the contour of yarn Y.

On the assumption that receivers R1, R2 of FIG. 2A or FIG. 2B are adapted to the light supplied from the light source L, light fully impinges on the area of the receiving surfaces 4, 5 as defined by the slit apertures A1, A2 when yarn Y is absent. In the evaluation circuit C the value zero or a constant signal value (e.g. a voltage value) follows from the difference of the response signals of the two receivers R1, R2. When the yarn Y passes through the scanning zone 3 towards arrow 1, the portion which is defined by the slit aperture A1 is first shadowed, at least in part, onto the receiving surface 4 of receiver R1, and at a later time, the portion which is defined by slit aperture A2 is shadowed onto the receiving surface of the second receiver R2. During movement of yarn Y in the direction of arrow 1, yarn Y has already left the slit aperture A1, while it is still moving over the slit aperture A2. The time interval starting with an overlap of the contour of yarn Y with the slit aperture A1 or A2 up to the time at which the contour of yarn Y is maximum for the slit aperture A1 and A2, respectively, is extremely short, which has the advantage of a strong frequency portion of the response signal and thus of a strong modulation. This is also true for the period when the contour of the yarn Y is moved out of the portion of the slit aperture A1 and A2, respectively, resulting in a strong frequency portion for an effective modulation. Since the yarn Y moves differently in time and geometry for the two receivers R1, R2 and the defined portions thereof on the receiving surfaces 4, 5, a difference from which a strong useful signal can be derived is detected in the evaluation circuit C during yarn passage. Thanks to the strong frequency portions and the good modulation, the useful signal is significant and can be used for further processing by just taking a few amplification measures. Because of the arrangement of the slit apertures A1, A2, the sensor device S is insensitive to changes in the orientation of the longitudinal yarn direction D in the scanning zone 3 and relative to the direction in which the receivers R1, R2 are adjacent.

When the two receivers R1, R2 are acted upon due to an unwanted factor (vibrations, extraneous light, or the like), this might also result in response signals. However, since such an actuation takes place at the same time and with the same geometry, it is, at any time, possible to make a distinction between genuine and wrong useful signals and to derive only the genuine useful signals from the yarn passages and to further process said signals only.

Figure 3:
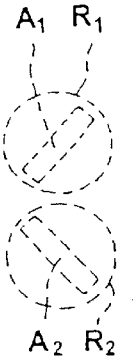
FIG. 3 diagrammatically shows a sensor device which is designed as a withdrawal sensor of a yarn feeding device.

In FIG. 3, the sensor device S is a withdrawal sensor of a yarn feeding device which on a storage surface B carries a yarn supply 13 consisting of a plurality of preferably axially spaced-apart yarn windings (yarn separation), from which the yarn Y is withdrawn beyond a withdrawal edge 12 in the direction of an arrow 2, with the yarn running in the direction of arrow 1 and passing through receivers R1, R2 with their upstream slit apertures A1, A2. 14 designates the border of the yarn supply 13 which is forwardly positioned in the direction of withdrawal. During operation of such a feeding device the axial position of border 14 varies considerably (double-headed arrow 15). As a result, the orientation of the longitudinal yarn direction D may also vary during yarn withdrawal in the area of receivers R1, R2 between almost axial and almost circumferential. This is outlined by arrows D. Despite this variation in the orientation of the longitudinal yarn direction D in the scanning zone of the sensor device, a significant useful signal is gained from a yarn passage, namely mainly because of the arrangement of the two slit apertures A1, A2 which are oriented relative to one another at an acute angle, with the signal indicating that a yarn winding has been withdrawn and the time when it has been withdrawn.

In FIG. 3, the slit apertures A1, A2 are arranged in the form of a T, with the transverse bar of the T being oriented next to the withdrawal edge 12 and in circumferential direction.

As outlined in broken line next thereto, a reverse arrangement of the slit apertures A1, A2 is also possible or even (as outlined at the left and in broken line) an inclined position of the two slit apertures A1, A1 with respect to the withdrawal edge 12 which extends in circumferential direction.

In all of the embodiments the slit apertures A1 are shorter than the diameter of the circular receiving surface of each receiver R1, R2. However, it is also possible to give the slit apertures the same length or even a greater length than the diameter of the receiving surfaces.

Figure 4:
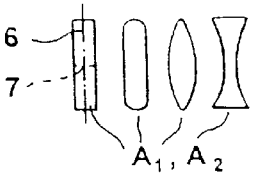
FIG. 4 shows a selection among possible forms for slit apertures which can be used in FIGS. 1, 3, and 7.

FIG. 4 diagrammatically illustrates a selection of possible shapes for the slit apertures A1, A2. A rectangular shape with the cross-sectional main axis 6 and the cross-sectional secondary axis 7 which is perpendicular to the cross-sectional main axis 6 is also possible. Furthermore, it is possible to give the slit apertures A1, A1 an oval, double-concave or double-convex shape, namely in such a manner that the contour of the yarn to be detected is positioned as quickly as possible and in its full size above the slit aperture and leaves the slit aperture again as rapidly as possible (short or almost no transition) to effect a strong frequency portion or a strong modulation for a strong useful signal.

Figure 5A:
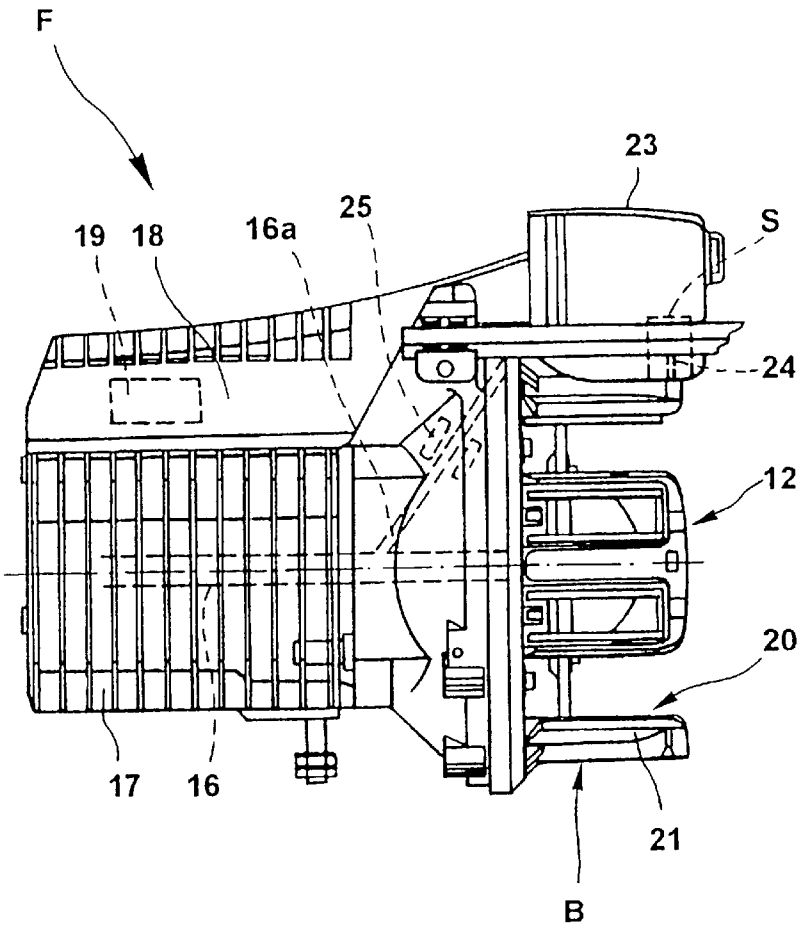
FIG. 5A is a side view of a weft-yarn measuring and storing device.
Figure 5B:
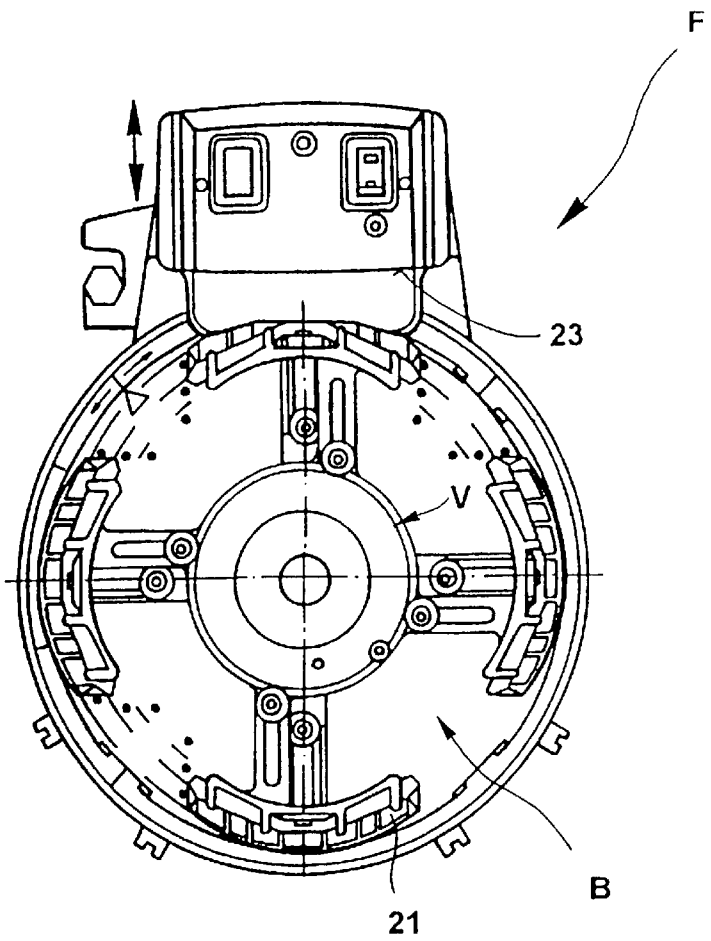
FIG. 5B is a front view pertaining to FIG. 5A.

FIGS. 5A, 5B show a concrete embodiment of a weft-yarn measuring and storing device F. These devices have been known since a long time and are, e.g., used for feeding a weft yarn to a jet loom, with the measuring and storing device F performing the task to always maintain the respectively withdrawable weft-yarn length at an adjustable value, in addition to the task to provide an intermediate yarn supply on a storage body, which yarn supply is sufficiently great for the respective pattern, for withdrawal at a withdrawal tension that is as constant as possible without emptying the yarn supply. A housing 17 has supported therein in a rotatably drivable manner a drive shaft 16 on which a storage body B, such as a rod drum or a rod cage 20 consisting of a plurality of axially extending and circumferentially spaced-apart rods 21, is rotatably supported per se. The storage body B, however, is kept in a stationary state by permanent magnets 25 which are arranged in the housing and in the storage body and prevent a rotational movement of the storage body B relative to the housing 17. The drive shaft 16 has mounted thereon a winding arm 16*a* which guides the yarn fed through the hollow-shaped drive shaft 16 from the left side in FIG. 5 to the outside up to the storage surface of the storage body B where upon rotation of the drive shaft 16 the yarn is deposited in successive windings in the reservoir 13 shown in FIG. 3. The free end of the yarn runs over the withdrawal edge 12 and is withdrawn approximately coaxial to the drive shaft 16 from the textile machine or jet loom (not shown). An extension arm 18 of the housing, which has provided thereunder a control device 19 for the drive of the storage device F, has secured thereto a housing 23 in which the optoelectronic sensor device S which serves as a withdrawal sensor is accommodated next to a stop device including a stop element 24. The yarn is withdrawn below the housing 23. The stop element 24 will be extend through a gap formed between the housing 23 and the adjacent rod 21 as soon as withdrawal of yarn is to be prevented. By contrast, when yarn is needed, the stop element 24 is retracted and yarn can be withdrawn. The sensor device S records every winding which has been withdrawn and supplies a useful signal representative of the time and the occurrence of a passage to the control device 19 which will again activate the stop element 24 before the yarn length to be withdrawn has been reached. The distance of the rods 21 from the axis of the device can be adjusted with a storage-body diameter adjusting device V, and thus the length of each yarn winding.

Figure 6:
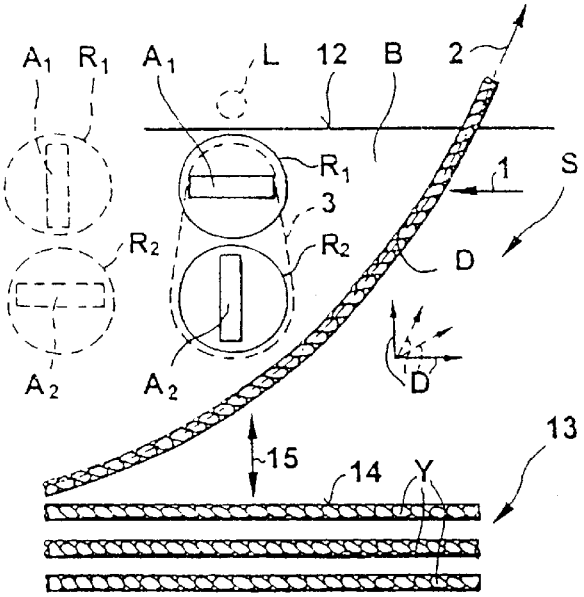
FIG. 6 is a longitudinal section of a detail regarding FIG. 5A.
Figure 6:
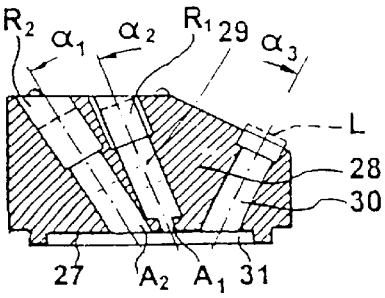
Figure 7:
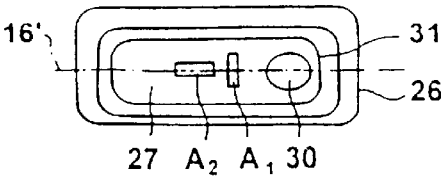
FIG. 7 is a bottom view with respect to FIG. 6.

FIGS. 6 and 7 show components of the sensor device S of FIG. 5. A block-shaped holder 26, for instance, a molded part of plastics, comprises a lower surface 27 which faces the storage body B. Three channels 28, 29 and 30 end in surface 27. Light source L is arranged in channel 30. Receivers R1, R2 are provided in channels 28 and 29. Slit apertures A1, A2 are formed into surface 27 in the openings of channels 28, 29. Furthermore, a transparent cover pane 31 may be arranged on surface 27.

In the illustrated embodiment, all of the three channels 30, 28, 29 are arranged in the same axial plane 17' of the storage body B. The channel 30 is inclined relative to a radial plane with respect to the drive shaft 16 at an angle $\alpha 3$ of about −27°, while channel 28 is inclined at an angle $\alpha 2$ of about +22° and channel 29 at an angle $\alpha 1$ of about +32°. The axes of all of the three channels are directed into the scanning zone 3. The withdrawal sensor S is expediently arranged directly next to the stop element 24 in the circumferential direction of the yarn during withdrawal.

The slit apertures A1, A2 could be formed into small aperture discs (outlined in FIG. 3) which are adjustable with respect to their rotary positions, for instance, to carry out an optimum adaptation of the relative positions of the slit apertures A1, A2 relative to each other and with respect to the axis of the storage body, depending on the rotational direction of the drive shaft or in consideration of the respective yarn geometry during withdrawal. Moreover, the two slit apertures A1, A2 could be provided jointly in fixed relationship with each other in a small aperture plate which is rotatable for adaptation purposes.

I claim:

1. In an optoelectronic sensor device for detecting a yarn passing through a scanning zone in a direction transverse to the longitudinal direction of said yarn, comprising a light source which illuminates the scanning zone, and at least one receiver which is responsive to light variations and oriented with a receiving surface towards the scanning zone and which is connected to an electronic evaluation circuit, and further comprising a slit aperture which is associated with said receiver and arranged between said yarn and the receiving surface of said receiver, comprising the improvement wherein at least two said receivers are provided which are disposed closely adjacent to each other and are oriented towards said scanning zone, at least two said slit apertures being provided wherein one of said slit apertures is provided in front of each of the receiving surfaces of said receivers, each of said slit apertures having a geometrical configuration with a long cross-sectional main axis and a short cross-sectional secondary axis which is essentially perpendicular to said main axis, and said slit apertures being arranged relative to one another such that the cross-sectional main axis of one of said slit apertures forms an angle of 90° or less with the cross-sectional main axis of an adjacent one of the slit apertures.

2. The sensor device according to claim 1, wherein each of said receiving surfaces has a shape which is approximately a full circle in the direction of impinging light passing the slit aperture that is associated with said receiving surface, and the length of said cross-sectional main axis of each said slit aperture is shorter than the diameter of said full circle.

3. The sensor device according to claim 1, wherein said receivers are jointly connected to the evaluation circuit, said evaluation circuit being formed as a differential circuit.

4. In a weft-yarn measuring and storing device comprising a generally cylindrical storage body having a weft yarn thereon, and an optoelectronic sensor device which is associated with said storage body as a withdrawal sensor for the weft yarn which said weft yarn is withdrawable in a revolving manner from said storage body, said sensor device comprising at least two optoelectronic receivers which are arranged one after the other in the axial direction of said storage body, at least one light source for illuminating a scanning zone proximate said storage body, and an electronic evaluation circuit for generating a signal on the basis of light variations occurring at said receivers during each passage of said weft yarn through said scanning zone with a movement essentially perpendicular to a longitudinal direction of said weft yarn, comprising the improvement wherein a slit aperture is provided in front of each of said receivers between said scanning zone and said receivers, said slit apertures being disposed essentially in a common plane and one of said slit apertures being arranged relative to the other of said slit apertures such that an angle of 90° or less is formed between said slit apertures.

5. The measuring and storing device according to claim 4, wherein said one slit aperture extends in the circumferential direction of said storage body and said other slit aperture extends in the axial direction of said storage body.

6. The measuring and storing device according to claim 5, wherein said two slit apertures are arranged in the form of a T.

7. The measuring and storing device according to claim 4, wherein an imaginary extension of said one slit aperture intersects said other slit aperture.

8. The measuring and storing device according to claim 4, wherein each of said slit apertures has a rectangular, double-concave or double-convex aperture configuration.

9. The measuring and storing device according to claim 4, wherein said slit apertures have the same shape.

10. The measuring and storing device according to claim 4, wherein a reflector is arranged on said storage body in said scanning zone, a housing being stationarily arranged outside of said storage body and having arranged therein a block-shaped holder, said holder having a surface facing said scanning zone and containing channels terminating with mouths that open through said surface and are in alignment with said scanning zone, said channels receiving said light source and said receivers therein, and the mouths of said channels that receive said receivers being formed as said slit apertures having an approximately rectangular aperture configuration.

11. The measuring and storing device according to claim 10, wherein said channels are positioned in a common axial plane of said storage body, said channel that receives said light source being inclined relative to a radial plane of said storage body by about −27°, and said one channel of said one receiver being inclined at about +22° and said other channel of said other receiver at about +32° relative to said radial plane.

12. The measuring and storing device according to claim 10, wherein the distance defined in an axial direction of said storage body between said slit apertures corresponds approximately to the width of each said slit aperture.

13. The measuring and storing device according to claim 10, wherein each of said slit apertures or both of said slit apertures is/are cut out in a small aperture plate which is held with a selectable and adjustable rotary position in a mount either in the surface of said holder or in the mouths of said channels.

14. In a weft-yarn measuring and storing device comprising a storage body having a weft yarn thereon, and an optoelectronic sensor device for detecting movement of said weft yarn in a transverse direction that is oriented transverse to a longitudinal direction of said weft yarn, said optoelectronic sensor device comprising at least one light source which illuminates a scanning zone disposed proximate said storage body, at least two optoelectronics receivers which each include a receiving surface oriented towards said scanning zone, and an evaluation circuit connected to said receivers for detecting light variations occurring at said receivers during passage of said weft yarn through said scanning zone in said transverse direction, comprising the improvement wherein each of said receivers includes a slit aperture disposed between said receiver and said scanning zone such that said receivers detect light variations in said scanning zone through said slit apertures, each of said slit apertures being elongated to define a longitudinal axis, said slit apertures being oriented transverse relative to each other such that said longitudinal axes of said slit apertures define an angle of 90 degrees or less therebetween.

15. The measuring and storing device according to claim 14 wherein said storage body extends in axial and circumferential directions, one of said slit apertures extending generally circumferentially and another of said slit apertures extending generally axially relative to said storage body.

16. The measuring and storing device according to claim 14, wherein said slit apertures are disposed substantially in a common plane.

17. The measuring and storing device according to claim 16, wherein said storage body extends in axial and circumferential directions, said longitudinal axes of said slit apertures being oriented transverse to said circumferential and axial directions.

18. The measuring and storing device according to claim 14, wherein said slit apertures are defined by separate plates.

19. The measuring and storing device according to claim 14, wherein said slit apertures are defined by a block, said receivers being supported on said block so as to face in the direction of said slit apertures toward said scanning zone.

* * * * *